United States Patent [19]

Beavers

[11] 3,941,140

[45] Mar. 2, 1976

[54] FOLDABLE FREE-STANDING TENT, FRAME AND SUBFRAME THEREFOR

[75] Inventor: Allan E. Beavers, Littleton, Colo.

[73] Assignee: T. A. Pelsue Company, Englewood, Colo.

[22] Filed: Oct. 31, 1974

[21] Appl. No.: 519,624

[52] U.S. Cl. ..... 135/4 R; 135/3 R; 135/15 CF; 135/DIG. 7; 135/DIG. 9; 403/217

[51] Int. Cl.[2] ..... A45F 1/16

[58] Field of Search ..... 135/1 R, 3 R, 4 R, 7.1 R

[56] References Cited

UNITED STATES PATENTS

| | | | |
|---|---|---|---|
| 1,231,735 | 7/1917 | Harris | 135/7.1 R |
| 1,773,847 | 8/1930 | Nickles | 135/4 R |

FOREIGN PATENTS OR APPLICATIONS

| | | | |
|---|---|---|---|
| 723,135 | 6/1942 | Germany | 135/4 R |

*Primary Examiner*—Werner H. Schroeder
*Assistant Examiner*—Conrad L. Berman
*Attorney, Agent, or Firm*—Edwin L. Spangler, Jr.

[57] ABSTRACT

This invention relates to an improved foldable wall-supporting subframe for fabric-covered collapsible tent walls and the like, such improvement consisting of attaching the strut sections of each jointed pair thereof to the connector in slightly overlapped transversely-spaced side-by-side relation so as to maximize the spacing between each axis of pivotal movement and the associated stop-forming abutment carried by said connector while, at the same time, minimizing the size of the latter. The invention also encompasses the collapsible tent structure which comprises a pair of the improved subframes hingedly interconnected at their adjacent corners cooperating with one another in fully unfolded condition and with the floor of the cover linking them together to define a free-standing assembly. The invention further encompasses certain of the unique connections by means of which the frame and fabric covering therefor are detachably interconnected to form a self-contained unitary tent structure.

9 Claims, 18 Drawing Figures

FOLDABLE FREE-STANDING TENT, FRAME AND SUBFRAME THEREFOR

In my U.S. Pat. No. 3,810,482, I disclose a tent, frame and subframe which, despite its many advantages over the prior art units for the same purpose, nevertheless had a few shortcomings. One of these was the design of the subframe, particularly in the area of the connector. The rib-forming strut sections all extended radially outward from the connector and each was attached to the latter for pivotal movement about an axis spaced outwardly from the center thereof so as to leave room for the four strut sections to move into a side-by-side folded relation. Unfortunately, this same connector had to carry the stops on the periphery thereof that limited the fully unfolded position of the strut sections to an angle greater than 180° and less than approximately 220°. In so doing, the size of the connector had to be made inordinately large so as to spread the axis of pivotal movement and stop far enough apart to eliminate undue stress on the parts thus connected. Looking at this problem another way, if the distance separating the pivot pin mounting the strut section and the stop on the periphery of the connector is only an inch or so with a strut section a yard long, a mechanical advantage of some 30:1 or so is acting to deform, bend or otherwise damage the parts. Now, while the tension exerted by the stretchable cord reaved around the free ends of the strut sections can easily be adjusted so as to not overload this connection, other forces cannot such as, for example, pressing against the inside wall of the tent which is a very common occurrence when confined in a small area. By the same token, a small gain by way of an increased spacing between the pivot axis and associated stop results in a considerable reduction in the mechanical advantage responsible for the excessive loads to which the assembly is subjected. Obviously, doubling the space between the pivot pin and stop results in the mechanical advantage being reduced by over 50%; however, the important thing to remember is that this can be achieved by moving the stop away from the pin perhaps as little as an inch or even less.

To accomplish the foregoing by increasing the size of the connector, however, creates more problems than it solves. Weight is always a problem in a portable structure such as this and enlarging the size of the connectors substantially contributes to an undesirable increase in this area. Even more important, however, is the attendant increase in bulk of the assembly in folded condition. These connectors all end up in side-by-side nested relation to one another as shown in FIG. 3 of my earlier patent and it is easy to imagine what effect increasing the size of the connectors would have upon the overall bulk of the bundle thus formed.

The tent of my earlier patent had no floor so as to provide access to an underground installation through an open manhole covered thereby. The cover, while attached to the frame, contributed nothing by way of cooperating therewith to produce a free-standing structure as the frame alone provided the necessary structural support. Also, while the stretchable cords outlining the subframes were attached to the cover by enclosing same within hems stitched along the borders thereof, no connection was provided between the frame and fabric in the center of the walls and roof. This proved to be a disadvantage because, when the tent was collapsed, the fabric covering the subframes did not follow the connector inwardly so as to fold inside the strut sections.

It has now been found that these and other shortcomings of my earlier tent can be eliminated by, first of all, mounting the sections of each strut in transversely-spaced side-by-side relation with their adjoint ends slightly overlapped. By so doing, the same size connector can be rearranged to provide over twice the space separating the axis of pivotal movement and stop means as was possible with my earlier design. By so rearranging the connector, the center thereof is left free to accept a line from the adjoint fabric wall covering same that cooperates with said connector to pull the fabric and fold same within the bundle of strut sections as the subframe is collapsed.

The tent of the present invention is designed primarily for camping rather than a cover for the entryway into underground installations, therefore, it can and does include a floor which cooperates with the subframes supporting the side walls to define a stable free-standing structure which it would not be without the floor or some analogous connection between the bottom margins of the side walls. This floor, in fact the ground-engaging underside thereof, ends up as the outside cover for the tent in collapsed condition. As such, it keeps most of the dirt on the outside where it can most easily be removed. Also, by making the floor of heavier stock than the walls, it offers substantial protection for the remainder of the assembly folded inside thereof.

Finally, to further reduce the strain on the connector when the subframe is unfolded, the strut sections, while still rigid, are preferably made of springable plastic rods that will bow slightly under load and thus relieve some of the stress on the pivot pins, stops and the like. As these strut sections bow outwardly, they stretch the fabric covering them taut and present a much neater looking tent as well as one having a slightly increased volume.

Accordingly, it is the principal object of the present invention to provide a novel and improved ground tent.

A second objective is the provision of a tent of the type aforementioned which includes a unique foldable wall-supporting subframe.

Another object of the invention herein disclosed and claimed is to provide a tent wherein the cover, more particularly the floor, cooperates with the wall-supporting subframes to define a stable free-standing structure which would not exist without such a cooperative relationship.

Still another objective of the within described invention is the provision of a unitary collapsible tent structure wherein the entire frame and wall structure in folded condition be enveloped within the floor and protected thereby.

An additional object is the provision of a novel and improved strut connector which minimizes the size and weight thereof while, at the same time, reducing the loads to which the subassembly of which it forms a part is normally subjected.

Further objects are to provide a collapsible ground tent that is compact, extremely fast and easy to both erect and take down, one that is lightweight yet roomy, rugged and versatile.

Other objects will be in part apparent and in part pointed out specifically hereinafter in connection with the description of the drawings that follows, and in which.

Figure 1:
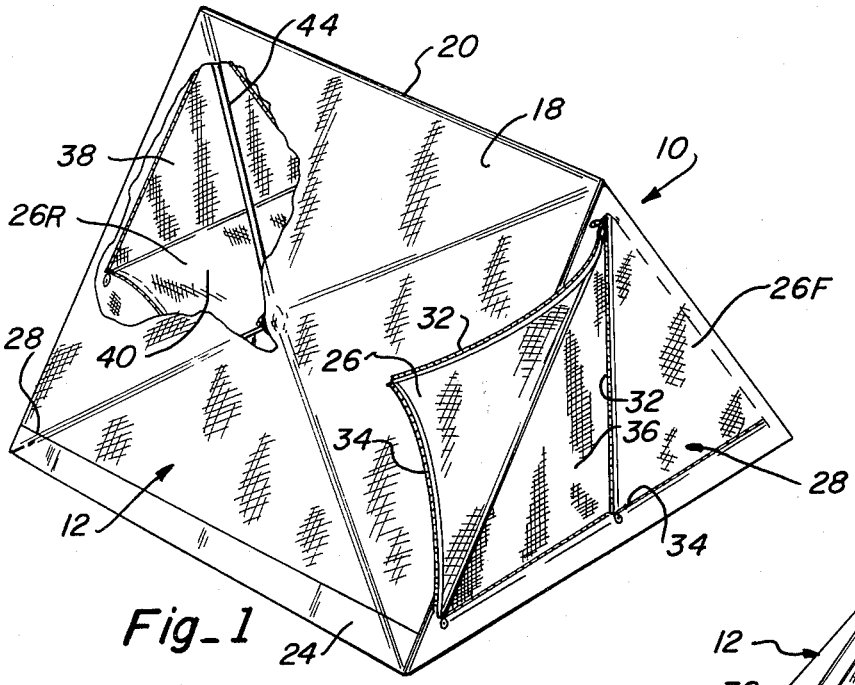
FIG. 1 is a perspective view looking down and to the right upon the front of the tent, portions of the near side wall having been broken away to reveal the interior construction.

Referring next to the drawings for a detailed description of the present invention and, initially, to FIGS. 1–5 inclusive, for this purpose, reference numeral 10 has been used to broadly designate the ground tent in its entirety while numeral 14 similarly designates the frame thereof and numeral 12 the cover or skin. Frame 12 is further broken down into a pair of substantially identical subframes that have each been referred to in a general way by numeral 16.

In the particular form shown, the tent 10 is of traditional shape having a pair of generally rectangular side walls 18 joined together along their common upper margin 20. The walls slope downwardly and outwardly in divergent relation from the ridge defined by upper margin 20. The ground is covered by a floor 22 forming an integral part of the cover 12. As illustrated, this floor has an upstanding marginal cuff 24 which adjoins the side walls and the triangular end walls 26. Cuff 24 also provides pockets 28 along opposite sides thereof that receive and retain the lower marginal edges 30 of the frame subassemblies 16 and prevents them from spreading apart. The cover 12 thus cooperates with the frame 14 in assembled relation to produce a stable free-standing structure that neither is capable of producing alone.

Figure 3:
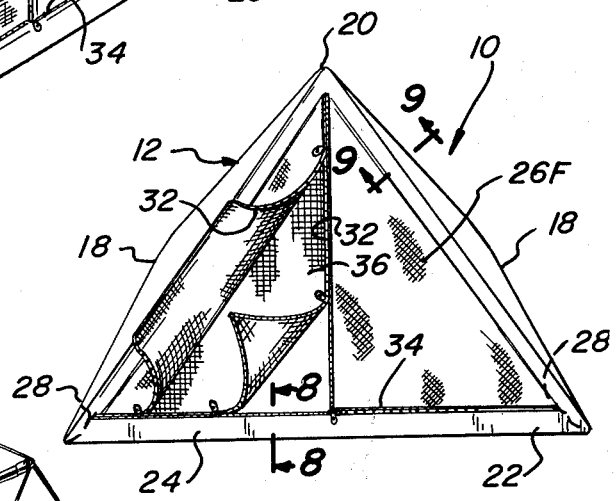
FIG. 3 is a front elevation.

In FIGS. 1 and 3 it can be seen that the front end wall 26F is divided in half by a vertical zipper fastener 32 that joins a horizontal zipper fastener 34 along the top of the cuff 24. Opening these two zippers frees a pair of flaps that provide both ventilation and access in the usual manner. As illustrated, a net wall 36 similarly zippered is placed behind front wall 26F to keep out insects while insuring the free circulation of air.

Figure 5:
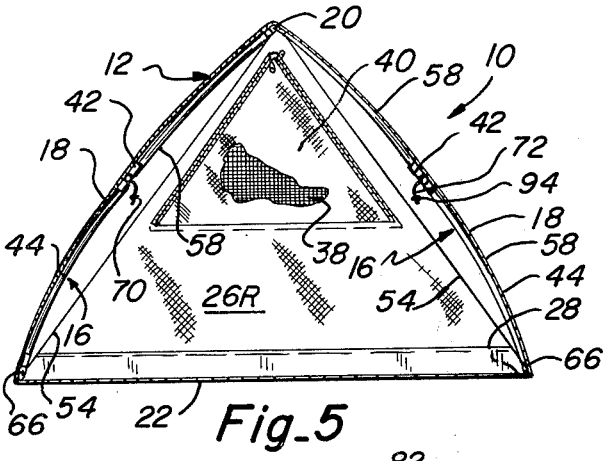
FIG. 5 is a section to the same scale as FIG. 3 taken along line 5—5 of FIG. 4.

Rear wall 26 does not open up the same way as the front wall 26F but, instead, is provided with a net-covered window 38 as shown in FIGS. 1 and 5. This window is covered by a zippered flap 40. While features such as the construction of these end walls is optional and well within the skill of an ordinary artisan, the triangularly-shaped tube defined by the side walls and floor cooperates in a unique way with the frame 14 to produce a unitary collapsible assembly with no loose parts that can be set up or taken down without the use of any tools, stakes and the like by a completely unskilled person in literally a matter of a few seconds. The manner in which this desirable end is achieved will now be set forth in detail with specific reference first of all to FIGS. 2, 11, 12 and 13 for a description of the improved subframe 16.

Each subframe has a hub-forming connector 42 to which is pivotally attached two pairs of jointed struts 44 disposed in right-angular intersecting relation to one another. The sections of each strut have their adjacent ends 46 arranged in side-by-side transversely-offset slightly overlapped relation as revealed most clearly in FIG. 11. These ends thus offset and overlapped lie on opposite sides of the center 48 of the connector but are mounted, in the particular form shown, for independent pivotal movement about a common axis 50 passing through the latter. It is, of course, possible to mount each strut section for pivotal movement about a separate axis as well as one that does not pass through the center of the connector. In fact, as previously noted, the greater the spacing between axis 50 and the edge 52 of the connector that defines the stop which limits the movement of each section into fully-extended position, the better it is for lowering the stress placed upon the subassembly by a strut section of a given length. Thus, by adopting this offset and overlapped configuration in preference to the design of my earlier patent where the ends of the strut sections were spaced apart on opposite sides of the center of the connector but in longitudinal alignment with one another, I am able to easily double the distance separating axis 50 from the stop-defining edge 52 of the connector and thereby halve the stress on the latter element without increasing its size. Furthermore, one can greatly reduce the overall size of connector 50 and still accomplish a significant reduction in stress through use of the improved subframe.

Figure 10:
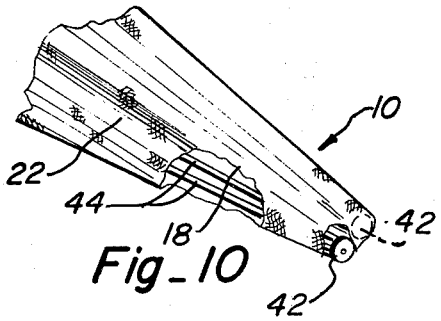
FIG. 10 is a perspective view showing the tent in fully folded condition as it would be seen from a vantage point above and to the left thereof.
Figure 7:
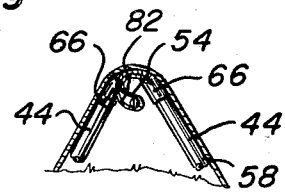
FIG. 7 is a fragmentary section to the same scale as FIG. 6 taken along line 7—7 of FIG. 4.
Figure 6:
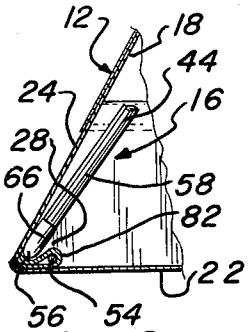
FIG. 6 is an enlarged fragmentary section taken along line 6—6 of FIG. 4.
Figure 8:
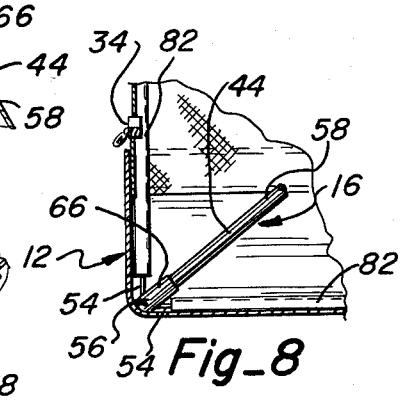
FIG. 8 is a fragmentary section to the same scale as FIGS. 6 and 7 taken along line 8—8 of FIG. 3.
Figure 9:
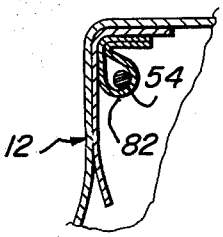
FIG. 9 is a fragmentary section to the same scale as FIGS. 6–8 inclusive, taken along line 9—9 of FIG. 3.
Figure 12:
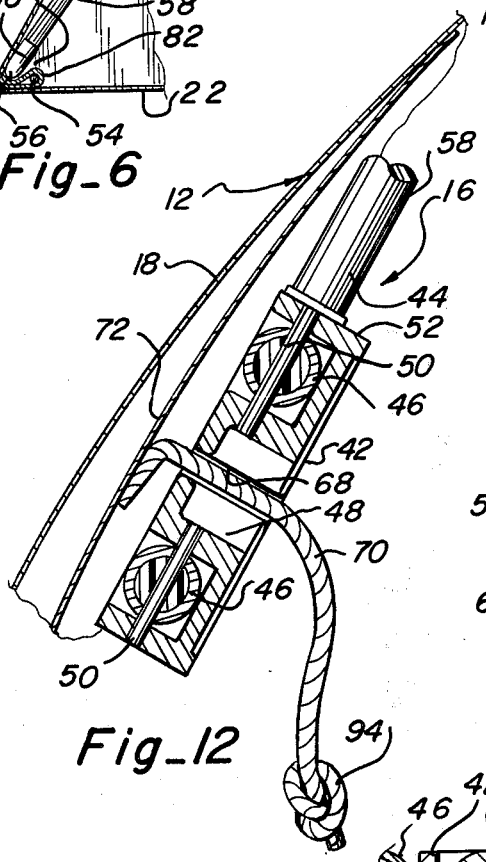
FIG. 12 is a fragmentary section taken along line 12—12 of FIG. 11 to the same scale as the latter.
Figure 11:
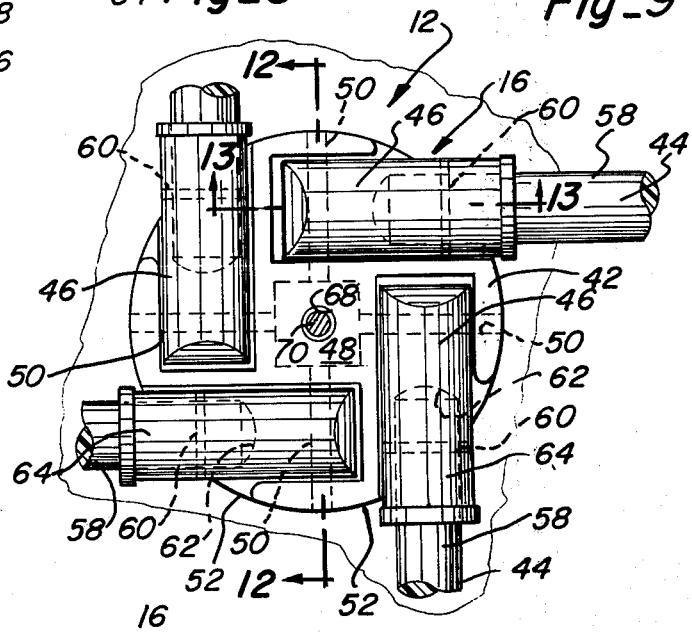
FIG. 11 is a fragmentary view to a further enlarged scale showing the connector, stop and strut section subassembly.
Figure 13:
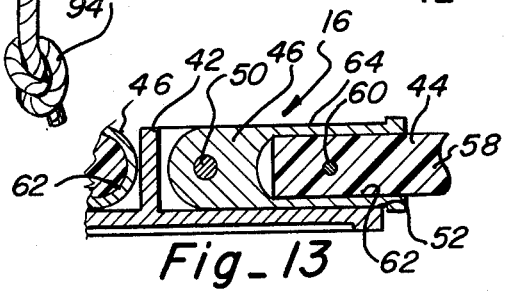
FIG. 13 is a fragmentary section to the same scale as FIGS. 11 and 12 taken along line 13—13 of FIG. 11.

Now, the marginal edge 52 of connector 42 cooperates with the pivot axis 50 of the strut sections 44 in the same manner as my earlier patent to limit the fully unfolded relation between said sections of each foldable strut to one in which they bear an angular relationship to one another that exceeds 180° yet is less than approximately 220°. This so-called "over center" condition is releasably maintained by a stretchable cord 54 connected to the remote ends 56 of each strut section. In the collapsed or folding condition illustrated in FIG. 10, the strut sections lie in side-by-side more or less parallel relation with both connectors 42 alongside one another at the same end as shown.

Figure 2:
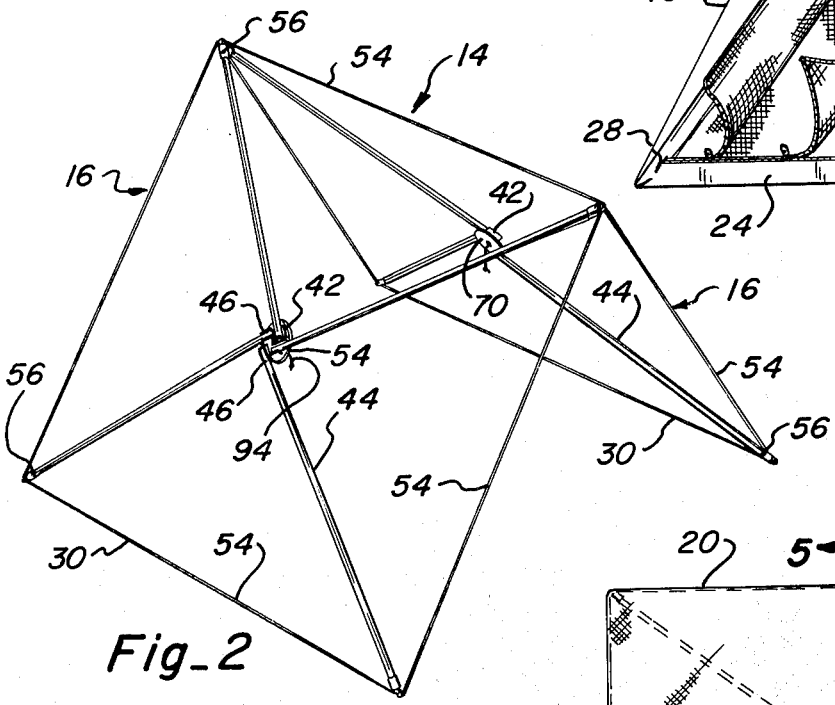
FIG. 2 is a perspective view like FIG. 1 and to the same scale of the frame alone.
Figure 4:
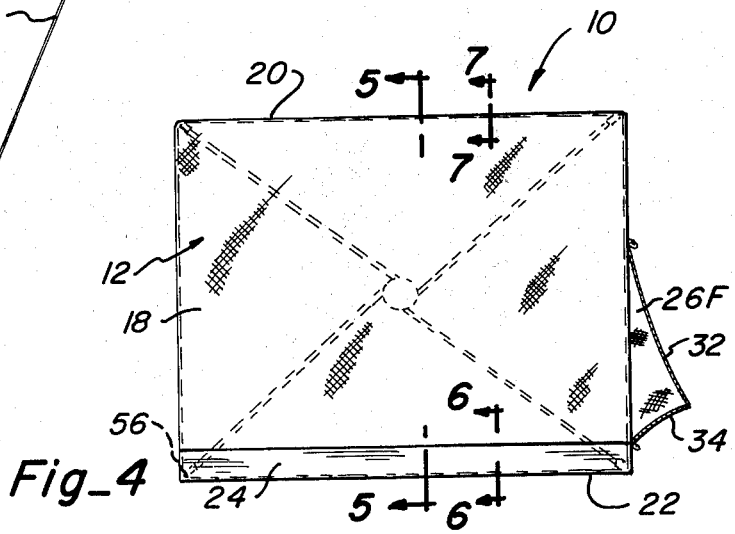
FIG. 4 is a side elevation to a slightly reduced scale.

In FIG. 2, it will be noted that segment 54C of cord 54 is shared by the two subframes 16 and extends along the ridge defined by upper marginal edge 20. As such, this segment permanently joins these two subframes together to produce the tent frame 12. The frame thus formed is further permanently attached to the cover or skin 14 which cooperates therewith to produce a unitary assembly to which detailed reference will be made presently.

In FIGS. 5–9, 11, 12 and 13 it can be seen that the strut sections include springable midsections 58 fabricated from plastic rods, the opposite ends of which are permanently attached by means of pins 60 into sockets 62 provided in the fittings 64 and 66 that are located on the adjacent and remote ends thereof, respectively. Connector 42 has a hole 68 in the center thereof through which passes a short lanyard 70 that is sewn as otherwise attached to a patch 72 (FIG. 12) similarly attached to the side wall 18 of the tent skin 12. Accordingly, a pull upon lanyard 70 will draw the side wall up snug against the connector 42 and thus return the strut sections back over center into the folded condition of FIG. 10, all the while insuring that the side wall will be inside the strut sections in their bundled condition. In my earlier tent, I showed no such connection and the struts could be folded leaving the fabric covering same on the outside.

Next, with reference to FIG. 5, it will be seen that the bendable nature of the strut sections is such that they will assume an outwardly bowed configuration when fully unfolded and held under stress by the tensioned cord 54 connected from the remote end of one strut section to the next. As thus bowed, the subframes serve to remove all slack from the side wall fabric thereby keeping it taut and free of the flapping noise which is so annoying when the wind blows against the loose walls of the ordinary tent. This same bowable subframe makes it far easier to adjust cord 54 which can be pulled taut enough to establish the bowed condition illustrated knowing that the strut sections will yield and not break the cord as they move between their folded and unfolded positions relative to connector 42.

Now, the fittings 66 on the remote ends of the strut sections differ materially from those (64) on the adjacent ends pivotally attached to connector 42 and they are most clearly revealed in FIGS. 14–17 to which detailed reference will now be made. A somewhat shallower socket 62M is provided for plastic midsection 58 and the latter is held in place by crimping the end of fitting 66 as shown at 74 rather than using a pin connector.

The other end of the fitting opposite that containing socket 62M is longitudinally slotted as shown at 76. At the base of the slot is a relatively narrower keyway 78 of a width adapted to pass the cord 54 while retaining ball 80 swaged on the end of said cord releasably locked within the slot in the manner clearly shown in FIG. 15. Both terminal ends of the cord 54 are provided with balls 80 and are thus detachably fastened within the fitting 66 on the remote end 56 of each strut section. In my previous patented construction, I use a single long length of cord to connect all the strut ends of each individual subframe together, however, the instant construction wherein separate segments of cord 54 of a length selected to span the gap separating one unfolded strut section from the next is preferable. For one reason, in case of damage to one cord segment, it can be replaced quite easily without having to unthread and rethread the cord through the cord-retaining sleeves 82 that are provided at the corners between the side and end walls as well as between the walls and the floor.

Figure 14:
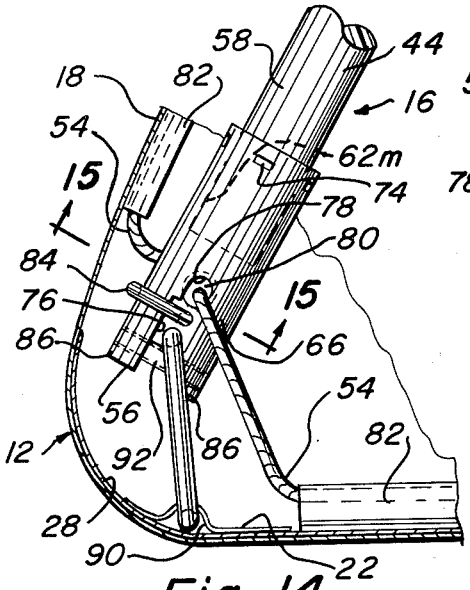
FIG. 14 is a fragmentary detail to the same scale as FIGS. 11–13, inclusive, showing the details of the corner subassembly where the floor joins the side wall and end wall.
Figure 15:
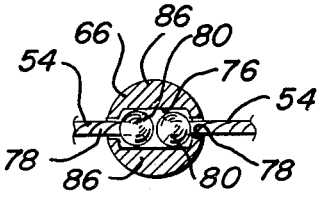
FIG. 15 is a fragmentary section taken along line 15—15 of FIG. 14.
Figure 16:
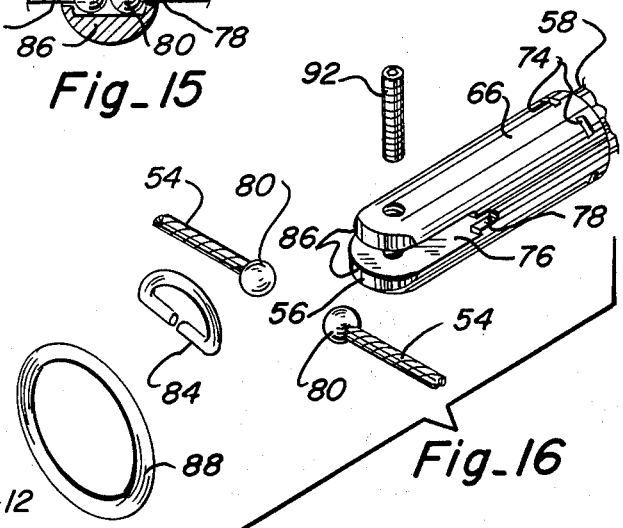
FIG. 16 is an exploded view to the same scale as FIGS. 11–15 showing the end subassembly of FIG. 14.
Figure 17:
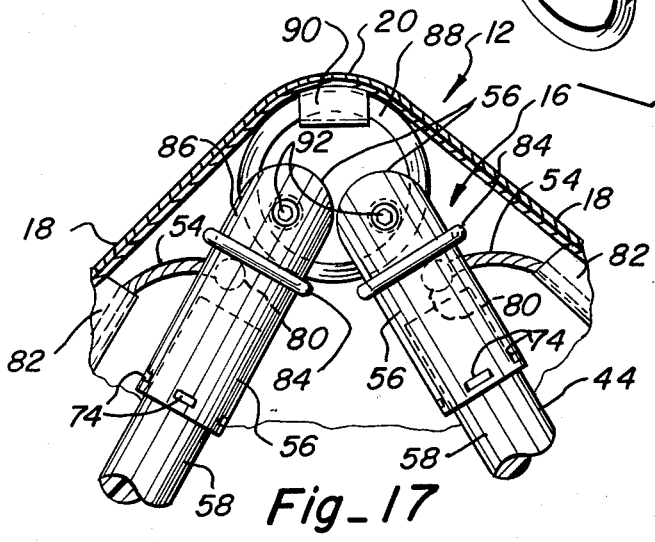
FIG. 17 is a fragmentary view to the same scale as the figures immediately preceding same showing the hinged connection between the two subframes; and, FIG. 18 is a fragmentary corner detail of the same corner depicted in FIG. 14 except that it shows only the fabric cover without the associated hardware in perspective.
Figure 18:
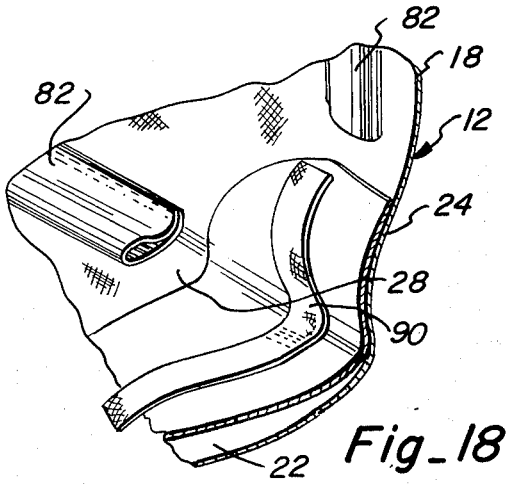

Once the terminal ends of the cord segments are positioned in the keyslots 78 and the balls 80 retained therebehind, D-rings 84 are passed onto one of the fingers 86 cooperating with slot 76 to define a bifurcated end on fitting 66. This D-ring blocks the mouth of keyslot 78 in the manner shown most clearly in FIG. 14 and prevents the cord end from backing out of the latter. A large metal O-ring 88 is then inserted into slot 76 on top of the D-ring as shown in FIGS. 14 and 17. Straps 90 in the four corners of the tent floor tie onto these rings 88 and thus provide a releasable connection between the subframes and fabric cover at floor level. A similar strap at the front and rear corners of the ridge (FIG. 17) ties onto O-rings 88, a single one of which is shared by the corresponding strut sections of the two side wall-supporting subframes and used to connect same together. A retaining pin 92 screwed into aligned internally-threaded openings 94 in the fingers 86 of the bifurcated fitting end bridges the slot 76 therein and retains the O-ring, D-ring and cord ends in assembled relation. D-ring 84 can, of course, be opened up and removed to release the balls from the keyslots in case a cord needs to be replaced without having to untie the O-ring from the corner straps.

Next, referring briefly to FIGS. 6–9, 14, 17 and 18 it will be seen that cord-retaining sleeves 82 comprise a single width of fabric folded over upon itself to form a tunnel, the marginal edges of which are then hemmed while, at the same time, sewing the sleeve thus formed to the fabric of the tent. These sleeves extend along all corners formed between adjacent walls and these walls and the floor so as to shield the cord from wear and damage. They also terminate short of the corners when adjoining side and end walls meet the floor as well as where the side walls adjoin one another along the ridge 20 to provide room for connecting the O-rings to the straps.

Finally, in connection with FIGS. 1–5 and 10, it will become apparent that a pull on cords 70 from inside the tent will effect an instant folding of the subframes and a total collapse of the tent. The knots 94 in the ends of lanyard 70 insure the fact that the side walls 18 will fold into the bundle of folded strut sections as they define stops preventing withdrawal of the lanyard from central opening 68 in the connector. Obviously, as the subframes fold, the connectors 42 will drop down onto the floor and lie closely adjacent one another quite near the center thereof. Then, in folding the strut sections into bundled relation, the floor 22 of necessity ends up on the outside of the package thus formed so that all the frame members, walls, cord and hardware end up fully protected inside thereof. In addition, that portion of the floor, namely the underside thereof that lay on the ground, ends up still on the outside of the package where it makes little difference whether it is soiled or not. Furthermore, the floor is preferably made of stouter stock than the walls which further insures that the elements enveloped thereby will not be damaged during storage and handling of the tent in collapsed condition.

What is claimed is:

1. A ground tent which comprises: a pair of collapsible subframes effective in open position to define a framework capable of supporting a wall covering when stood upon a lower edge, each of said subframes including three or more rigid strut sections and a centrally-located hub-forming connector, said strut sections each being pivotally connected at one end to said connectors for hinged movement from a folded position lying alongside one another on the same side of said connectors into an unfolded position radiating from the latter in angularly-spaced relation; fastener means hingedly connecting said subframes together at points remote from said lower edges; foldable means connecting said lower edges of the subframes together so as to limit the maximum separation therebetween when unfolded; foldable sheet means covering both subframes cooperating therewith to define a wall, the marginal edges of said sheet means being attached to the strut sections at the ends thereof remote from said ends pivotally attached to the connector; and, fastener means connecting said connector to the portion of said sheet means covering same, said fastener means, connector and sheet means cooperating to draw said sheet means into a nest defined by the strut sections when the subframe is folded inwardly.

2. The ground tent as set forth in claim 1 in which: the strut sections are pivotally connected to the connector at points displaced to one side of the center thereof; the connector has a hole through its center; and, in which the fastener means comprises a lanyard attached to said portion of the sheet means and passed through the hole in the connector.

3. A ground tent which comprises: a pair of collapsible subframes effective in open position to define a framework capable of supporting a wall covering when stood upon a lower edge, each of said subframes including three or more rigid strut sections and centrally-located hub-forming connector, said strut sections each being pivotally connected at one end to said connectors for hinged movement from a folded position lying alongside one another on the same side of said connectors into an unfolded position radiating from the latter in angularly-spaced relation, and said struts having the ends thereof remote from said one end provided with opposed slots; stretchable cords strung between the slotted ends of adjacent strut sections; said cords being of a length selected to place same under tension when the subframe is unfolded, and said cords cooperating with one another and with the connectors to releasably maintain said subframe in unfolded condition; enlargements on the opposite ends of each cord sized to releasably lock same within said slots; fastener means hingedly connecting said subframes together at points remote from said lower edges; foldable means connecting said lower edges of the subframes together so as to limit the maximum separation therebetween when unfolded; foldable sheet means covering both subframes cooperating therewith to define a wall, the marginal edges of said sheet means being attached to the strut sections at said remote ends thereof; and, fastener means connecting said connector to the portion of said sheet means covering same, said fastener means, connector and sheet means cooperating to draw said sheet means into a nest defined by the strut sections when the subframe is folded inwardly.

4. A ground tent which comprises: a pair of collapsible subframes effective in open position to define a framework capable of supporting a wall covering when stood upon a lower edge, each of said subframes including three or more hollow rigid strut sections and a centrally-located hub-forming connector, said strut sections each being pivotally connected at one end to said connectors for hinged movement from a folded position lying alongside one another on the same side of said connectors into an unfolded position radiating from the latter in angularly-spaced relation; fastener means hingedly connecting said subframes together at points remote from said lower edges; foldable means connecting said lower edges of the subframes together so as to limit the maximum separation therebetween when unfolded; foldable sheet means covering both subframes cooperating therewith to define a wall; rings on the ends of each strut remote from said one end thereof; straps on the foldable sheet means positioned to tie onto the rings on the strut section ends forming a releasable connection therebetween; and, fastener means connecting said connector to the portion of said sheet means covering same, said fastener means, connector and sheet means cooperating to draw said sheet means into a nest defined by the strut sections when the subframe is folded inwardly.

5. The ground tent as set forth in claim 3 in which: the slots include a wide section sized to pass the enlargements on the ends of the cord and a relatively narrower section sized to pass said cord while blocking the passage of said enlargement.

6. The ground tent as set forth in claim 3 in which: rings are provided in the slotted ends of the strut sections positioned to block the removal of the cord ends therefrom; and, in which a pin is detachably fastened to said slotted strut end in position to provent removal of said ring from the slots.

7. A tent frame comprising in combination: a pair of collapsible subframes effective in open position to define a framework capable of supporting a wall covering when stood upon a lower edge, each of said subframes including three or more rigid strut sections and a centrally-located hub-forming connector, said strut sections each being pivotally connected at one end to said connector for hinged movement from a folded position lying alongside one another on the same side of said connector into an unfolded position radiating from the latter in angularly-spaced relation; fastener means hingedly connecting said subframes together at points remote from said lower edges; and, sheet fabric means connecting said lower edges of the subframes together so as to limit the maximum separation therebetween when unfolded, said sheet means also cooperating with the fastener means and with said subframes in open position to define a free-standing structure, and said sheet means further cooperating with said subframes in collapsed condition to envelop same and form a protective covering therefor.

8. The combination as set forth in claim 7 in which: the subframes fold inwardly toward one another.

9. The combination as set forth in claim 7 in which: the shortest distance separating the connector from said lower edge of the same subframe is less than half the width of the sheet means measured between said lower edges.

* * * * *